US009814119B2

(12) United States Patent
Steffens et al.

(10) Patent No.: US 9,814,119 B2
(45) Date of Patent: Nov. 7, 2017

(54) METHOD AND SYSTEM FOR ACTUATING LOADS CONNECTED TO A BUS SYSTEM

(71) Applicant: ZUMTOBEL LIGHTING GMBH, Dornbirn (AT)

(72) Inventors: Thomas Steffens, Lindenberg im Allgaeu (DE); Ralf Schladoer, Dornbirn (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 75 days.

(21) Appl. No.: 14/768,128

(22) PCT Filed: Feb. 13, 2014

(86) PCT No.: PCT/EP2014/052792
§ 371 (c)(1),
(2) Date: Aug. 14, 2015

(87) PCT Pub. No.: WO2014/125007
PCT Pub. Date: Aug. 21, 2014

(65) Prior Publication Data

US 2016/0007427 A1 Jan. 7, 2016

(30) Foreign Application Priority Data

Feb. 14, 2013 (DE) ..... 10 2013 202 363

(51) Int. Cl.
*H05B 37/02* (2006.01)

(52) U.S. Cl.
CPC ..... *H05B 37/0254* (2013.01)

(58) Field of Classification Search
None
See application file for complete search history.

(56) References Cited

U.S. PATENT DOCUMENTS 5,138,615 A * 8/1992 Lamport ..... H04L 45/02 370/400
5,592,622 A * 1/1997 Isfeld ..... G06F 13/387 709/207
5,974,056 A 10/1999 Wilson et al.
6,111,888 A 8/2000 Green et al.
6,990,540 B2 1/2006 Dalakuras et al.
7,668,994 B2 2/2010 Albrecht et al.
(Continued)

FOREIGN PATENT DOCUMENTS

DE 19510280 9/1995
DE 69207692 10/1996
(Continued)

OTHER PUBLICATIONS

International Search Report for PCT/EP2014/052792, English translation attached to original, Both completed by the European Patent Office dated Jun. 18, 2014, All together 7 Pages.

*Primary Examiner* — Crystal L Hammond
(74) *Attorney, Agent, or Firm* — Brooks Kushman P.C.

(57) ABSTRACT

A method for actuating loads connected to a bus system, in particular lamp operating devices, by at least one command generator which is likewise connected to the bus system. The actuation is carried out by the transmission of data packets, wherein the command generator fills a data packet region assigned to the command generator after the data packet transmission is initiated by a central clock generator.

13 Claims, 2 Drawing Sheets

(56) References Cited

U.S. PATENT DOCUMENTS

| | | | | |
|---|---|---|---|---|
| 7,826,492 | B2 | 11/2010 | Takeuchi | |
| 7,984,217 | B2 | 7/2011 | Beckhoff et al. | |
| 8,130,785 | B2 | 3/2012 | Weigl et al. | |
| 8,492,983 | B1 * | 7/2013 | Berg | H05B 37/0254 315/185 R |
| 2003/0218565 | A1 * | 11/2003 | Budic | G01S 7/023 342/90 |
| 2006/0022214 | A1 | 2/2006 | Morgan et al. | |
| 2006/0125426 | A1 | 6/2006 | Veskovic et al. | |
| 2008/0059671 | A1 | 3/2008 | Blumcke et al. | |
| 2008/0136334 | A1 * | 6/2008 | Robinson | H05B 37/0254 315/151 |
| 2009/0051506 | A1 | 2/2009 | Hicksted et al. | |
| 2011/0181200 | A1 | 7/2011 | Luk et al. | |
| 2014/0279463 | A1 * | 9/2014 | Pederson | G06Q 20/145 705/40 |

FOREIGN PATENT DOCUMENTS

| | | |
|---|---|---|
| DE | 19721740 | 11/1998 |
| DE | 10000305 | 7/2001 |
| DE | 69807235 | 12/2002 |
| DE | 10147445 | 4/2003 |
| DE | 10163342 | 7/2003 |
| DE | 102004063213 | 7/2006 |
| DE | 102006024744 | 5/2007 |
| DE | 102006040709 | 3/2008 |
| DE | 102011079891 | 1/2013 |
| DE | 102011079897 | 1/2013 |
| EP | 0784393 | 7/1997 |
| EP | 1748338 | 1/2007 |
| EP | 2247166 | 11/2010 |
| EP | 2475227 | 7/2012 |

* cited by examiner

METHOD AND SYSTEM FOR ACTUATING LOADS CONNECTED TO A BUS SYSTEM

CROSS-REFERENCE TO RELATED APPLICATION

This application is the U.S. national phase of PCT Application No. PCT/EP2014/052792 filed on Feb. 13, 2014, which claims priority to DE Patent Application No. 10 2013 202 363.4 filed on Feb. 14, 2013, the disclosures of which are incorporated in their entirety by reference herein.

The present invention relates to a method for controlling consumers which are connected to a bus system, wherein the control is carried out with the aid of at least one command generator which is also connected to the bus system. The consumers may in particular be lamp operating devices.

The integration of multiple luminaires into a shared illumination system provides a variety of advantages. One of the significant advantages is that a coordinated control of the luminaires may be carried out, so that a uniform appearance is maintained when illuminating larger spaces or larger building complexes. Because a corresponding control of the luminaires also takes into account the effect of daylight, it is also possible to save energy, since the brightness achieved with the aid of the available luminaires is enhanced and the luminaires accordingly do not always have to be operated at maximum brightness. Furthermore, there is the possibility of integrating different command generators into the system, with the aid of which it is possible to adapt the lighting to particular requirements of individual users or current situations. These additional command generators may, for example, be local operating elements such as light switches, dimmers, or the like. However, they may also be sensors, for example, brightness sensors or presence sensors.

The so-called DMX (Digital Multiplex) standard is a standard which is frequently used in lighting technology for controlling consumers connected to a bus system. This is a digital control protocol which was initially developed in stage and management technology for controlling dimmers, intelligent headlights, or other effects devices. Meanwhile, however, DMX is also being used in general lighting technology due to its high flexibility and manifold possibilities for controlling consumers.

In the original form, a DMX system includes a so-called unidirectional bus with a central command generator, the so-called DMX transmitter, and multiple receivers. The fact that DMX is initially unidirectional means that only the DMX transmitter is able to pass commands to the bus line, which are then detected by the receivers and implemented in an appropriate manner. However, in the basic version of DMX, the receivers themselves are not authorized to pass signals to the bus. If control information from additional command generators, for example, from sensors or the like, is to be taken into account, the DMX system is generally expanded into a bidirectional bus, in which, for example, RDM (Remote Device Management) or another proprietary protocol is used for this purpose. In this case, the central command generator continues to be the only unit which is authorized to pass signals from itself to the bus line. On the other hand, the additional command generators, for example, the sensors, are not authorized to do this. In this case, if the signal of a sensor, for example, a presence sensor for controlling multiple luminaires, is to be taken into account, according to the previous approach, the central command generator must contact the sensor and poll it with respect to its measured values. In response, the sensor then transmits the relevant information to the central command generator, which evaluates this information, and on the basis of which it then controls the corresponding luminaires.

It is apparent that in the approach just described, relatively complex data traffic exists until the measurement results of the sensor are finally converted into a corresponding control of the luminaires. In particular in the case that multiple command generators, i.e., sensors or other devices via which generate control information for controlling the consumer, are integrated into the system, it is necessary for the central command generator to poll these local command generators cyclically, thereby causing the data traffic to continue to increase. However, since the bandwidth available via the bus system is limited, this means that little bandwidth is available for the actual control of the consumers, for example, for the transmission of the lighting control variables for the various luminaires.

The object of the present invention is therefore to optimize the integration of command generators into a corresponding system so that corresponding control information may be passed more rapidly and effectively to the luminaires or generally to the consumers of the system, and the volume of the data transfer is kept as low as possible.

This object is achieved via a method for controlling consumers connected to a bus system according to claim 1 and via a system for controlling multiple consumers according to claim 8. Advantageous refinements of the present invention are the subject matter of the dependent claims.

The transmission of control commands to the consumers of a corresponding system generally takes place in the form of digital information which is combined into a data packet. Whereas it was previously common for a data packet to be generated exclusively by a single unit i.e., by the central command generator when controlling the luminaires, it is provided in the method according to the present invention that the sensors or operating devices of the system directly contribute to the generation of the data packet. This takes place as a result of the initiation of a data packet transmission via a central clock generator being carried out, and the sensor or the operating device, which is generally referred to below as a command generator or a local command generator (in contrast to a central command generator or a central control unit), then filling an area of the data packet previously assigned to it, i.e., transmitting data within the corresponding period of time.

According to the present invention, a method for controlling consumers connected to a bus system, in particular lamp operating devices, is accordingly provided, wherein the control is carried out via at least one command generator which is also connected to the bus system, and according to the present invention, the control is carried out via the transmission of data packets, and after the initiation of a data packet transmission via a central clock generator, the command generator fills an area of the data packet which is assigned to it.

The advantages of the approach according to the present invention become important in particular if the system includes multiple command generators, i.e., multiple sensors or operating elements which are connected to the bus system. In this case, a different area of the data packet, a so-called slot, is assigned to each command generator, in which, according to the aforementioned approach according to the present invention, after the initiation of the data packet transmission, each command generator fills the corresponding area of the data packet. Instead of the previous approach in which the information of the command generators was extensively polled by the central control unit and then converted into corresponding control information for the consumers, it is now possible for the corresponding control information to be passed by the local command generators directly to the consumers. In this case, all control information of the local command generators is then therefore transmitted to the bus system within the scope of a single data packet, which is obviously associated with very considerable time savings as well as a reduction of the data to be transmitted. The consumers in turn know which section or slot of a data packet originates from which command generator and are accordingly immediately capable of identifying and implementing the information of the command generator(s) which is relevant to them. The approach according to the present invention thus opens up the possibility of integrating a plurality of command generators into a bus system in a very simple and elegant manner, while managing to keep the complexity extremely low with respect to the data to be transmitted.

Thus, an important precondition for implementing the method according to the present invention is that the point in time at which the transmission of a data package collectively created in such a way takes place is clear to all devices in the system, i.e., both the command generator(s) and the consumers. This is handled by the aforementioned central clock generator, which informs all devices in the system in a corresponding manner and synchronizes them accordingly. The clock generator may be a completely independent unit or, for example, an integral part of a central command generator. Alternatively, however, the clock generator could also be integrated into one of the local command generators. In this context, it should be mentioned that in the method according to the present invention, all transmitted data packages do not necessarily have to come about in the previously described manner. Instead, it may absolutely be provided to use a central command generator which controls the consumers in a previously known manner, for example, as a function of time or the like. The generation of a data packet collectively created according to the present invention, with the aid of which the control information generated by the local command generator(s) is passed, is then able to take place only at particular time intervals. The approach according to the present invention thus constitutes an optimal enhancement of the previously existing practice for controlling consumers in a bus system.

An additional function which the clock generator is able to fulfill is that of compensating for the failure of one of the local command generators if needed. For this purpose, it may be provided that the clock generator monitors the filling of the corresponding sections of the data packet by the local command generators. In the event that the command generator or one of the command generators is not capable of filling the area of the data packet assigned to it, this is detected by the clock generator, which then immediately fills the corresponding area of the data packet with the data last transmitted by the command generator. Thus, for example, if one of the command generators is defective, this does not necessarily mean that the consumers will no longer receive corresponding control information or that the data packet will be erroneous or incomplete. Instead, the last-generated control information is transferred continuously by the clock generator to a corresponding position in the data packet, so that continuous operation of the consumers is ensured in this respect.

As already mentioned, the command generators may be sensors as well as operating elements. The method is not limited to a particular number of corresponding command generators, but may be expanded in virtually any arbitrary manner. The method generally constitutes an ideal extension of the DMX standard, i.e., the data transmission according to the method according to the present invention preferably takes place according to this DMX standard.

The present invention will be explained below in greater detail based on the attached drawings, in which.

Figure 1:
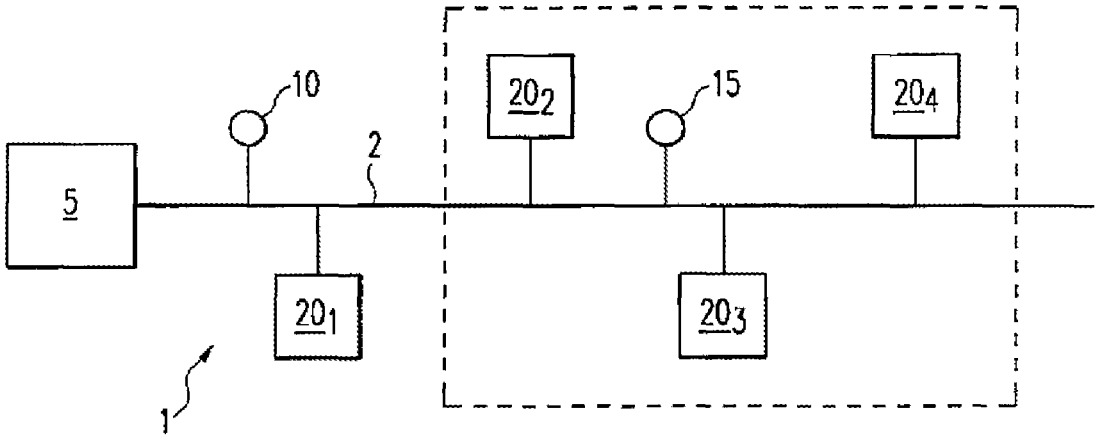
FIG. 1 shows the structure of a system according to the present invention for controlling multiple consumers.

FIG. 1 first shows an illumination system which is generalized to the greatest extent, in which a control is to be carried out according to the method according to the present invention. In the system depicted in FIG. 1 which is generally provided with the reference numeral 1, luminaires 20 or their operating devices are described as consumers. However, the method according to the present invention may generally be used for controlling all conceivable consumers. Within the context of the present invention, this means, for example, that air conditioning devices, venetian blinds, or the like could also be controlled, it also being absolutely possible for such units to be an integral part of the system, together with luminaires.

According to the depiction of FIG. 1, in the system 1 according to the present invention, all consumers 20, i.e., all luminaires, are connected to a shared bus system 2. This bus system 2 connects the consumers 20 to each other, but in particular also to units which are responsible for controlling the luminaires 20. In the present case, a central control unit 5 is provided for this purpose, which controls the data transmission via the bus system 2 in the manner which is described in greater detail below. Furthermore, however, local command generators 10 and 15 are also provided, which also generate information which is relevant to the control of the luminaires 20. The command generator 10 may, for example, be an operating element provided in a particular space, i.e., a switch or a dimmer, via which a user is able to directly control a correspondingly associated luminaire $\mathbf{20}_1$. On the other hand, the second command generator 15 could, for example, be formed by a presence sensor. This sensor detects the movement or generally the presence of persons within a particular area and is intended to cause the luminaires $\mathbf{20}_2$ through $\mathbf{20}_4$ located in the corresponding space to switch on as a result. Of course, the system 1 may also be expanded via other command generators, depending on which consumers are connected to the system 1 and the manner in which they are to be controlled. Particular mention should be made of brightness sensors for providing a control of the luminaires which is correspondingly adapted to the incident outside light, as well as temperature sensors and the like in order, for example, to control heating systems or the like.

The communication via the bus system 2 preferably takes place according to the DMX standard within the scope of a digital control of the consumers or luminaires 20, in which the use of a different communication standard would also be conceivable. One essential characteristic of the DMX standard is that only one unit, in the present case, the central command generator 5, is authorized to transmit control signals from itself to the bus system 2. Within the scope of an expansion to bidirectional communication, in particular, to the known RDM protocol, it would certainly be possible for individual devices in the system to transmit responses to the central command generator 5; however, the local command generators, i.e., the operating element 10 and the sensor 15, are not able to transmit control information from themselves to the luminaires 20. Instead, up to now, it has been necessary for these local command generators to be polled cyclically by the central command generator 5 and then to transmit their corresponding control information to the central command generator 5. This in turn then generated corresponding control commands for the luminaires 20, which were then transmitted via the bus system 2.

In order to simplify such complex data communication and in particular to optimize the time expenditure when controlling the luminaires 20, according to the present invention, a novel approach is now provided which allows for considerably more efficient control.

Figure 2:
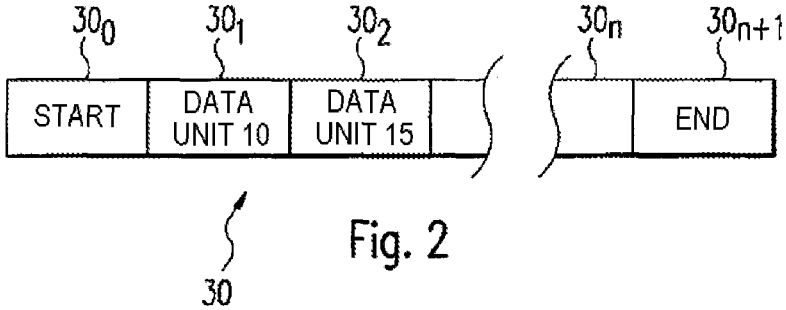
FIG. 2 shows the embodiment of a jointly generated data packet for controlling the consumers, corresponding to the method according to the present invention.

A first essential element of the present invention is that the transmission of control information to the consumers takes place with the aid of a data packet which, for example, is configured according to the schematic representation of FIG. 2. The data packet 30 is made up of multiple sections which are transmitted chronologically in succession, the so-called slots, which in particular contain a start sequence $\mathbf{30}_0$ and subsequent slots or sections $\mathbf{30}_1$, $\mathbf{30}_2$, etc., these areas containing corresponding control information which was generated by the local command generators. In particular, exactly one section is assigned to each command generator connected to the bus system 2, it being assumed for further illustration that the first section $\mathbf{30}_1$ is assigned to the operating element 10 and the following section $\mathbf{30}_2$ contains information with respect to the presence sensor 15. Depending on the number of local command generators connected to the system, the data packet depicted in FIG. 2 has a corresponding number of data areas, it being possible for another slot $\mathbf{30}_{n+1}$ having an end sequence then to follow at the end of the data packet if needed.

The use of a data packet transmitted in such a manner is based on the fact that, on the one hand, as already mentioned, each data area $\mathbf{30}_1$ through $\mathbf{30}_n$ is assigned to one of the command generators 10, 15, and on the other hand, the consumers, i.e., the luminaires 20, know which command generator and thus which data area contains the control information which is relevant to it. This must be taken into account during the commissioning of the system 1 in an appropriate manner and stored in the operating devices of the consumers. In the previously mentioned application case, this thus means that the data area $\mathbf{30}_1$ of the data packet 30 is relevant to the first luminaire $\mathbf{20}_1$. However, the three luminaires $\mathbf{20}_2$ through $\mathbf{20}_4$ are supposed to implement information contained in the second data area $\mathbf{30}_2$, which originates from the presence sensor 15, in an appropriate manner.

The particular feature of the method according to the present invention is now that the data packet 30 is generated not only by the central command generator 5 as previously, but instead, in particular the local command generators 10 and 15 also contribute to the generation of the data packet 30. In particular, it is provided that in this case, the central command generator 5 assumes only the function of a central clock generator which initiates the transmission of the data packet 30. This is achieved by the clock generator transmitting the first section of the data packet, i.e., the start sequence $\mathbf{30}_0$. As a result, all additional units connected to the bus system 2, i.e., both the command generators 10 and 15 and the luminaires 20, are synchronized, and the subsequent periods in which information is transmitted from the corresponding command generators 10 and 15 are known to all devices. These command generators 10 and 15 are now responsible for independently filling the slot or area of the data packet assigned to them, which takes place by transmitting data within the relevant period which corresponds to the slot. In this way, the entire data packet is generated jointly by the clock generator and all command generators, until the last data area $\mathbf{30}_n$ has been filled by the last command generator. Either the end sequence is then subsequently transmitted by the clock generator, or all devices know that the transmission of the entire packet 30 has ended due to the fact that the number of local command generators is known to them.

From the description above, it is apparent that information originating from the individual local command generators is thus able to be transmitted to the consumers considerably faster, since it is possible in particular to omit extensive cyclical polling via a central command generator. The volume of the transmitted data is also considerably reduced via the approach according to the present invention, so that the bandwidth of the bus systems is available for other purposes.

One refinement of the previously described basic principle could further be that the clock generator additionally also carries out a monitoring function and compensates for the failure of one of the local command generators if needed. This means that during the generation of the data packet, the clock generator monitors whether all local command generators actually fill the corresponding data sections of the packet. If this is not the case because, for example, one of the command generators is defective or the like, the clock generator detects this and fills the packet itself. In doing this, it preferably transmits the information which was last transmitted by the corresponding local command generator, so that in this case, the corresponding consumers therefore consistently continue their operation. However, it is not possible for the case to occur in which a consumer assumes uncontrolled operation due to a missing transmission of control information.

Figure 4:
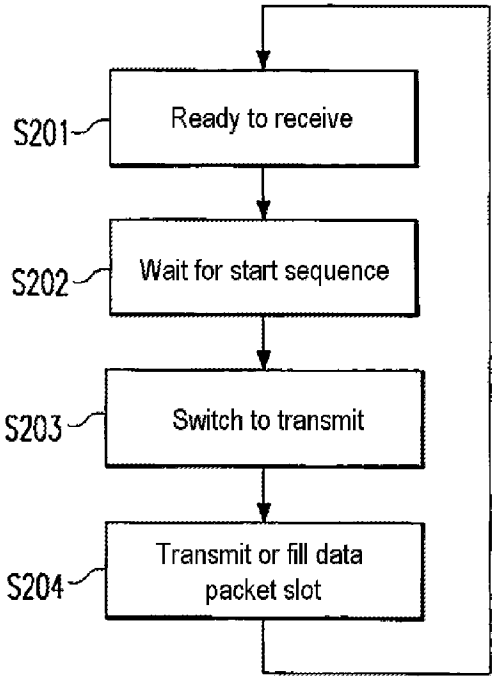
FIG. 4 shows the approach of a command generator for generating a data packet.
Figure 3:
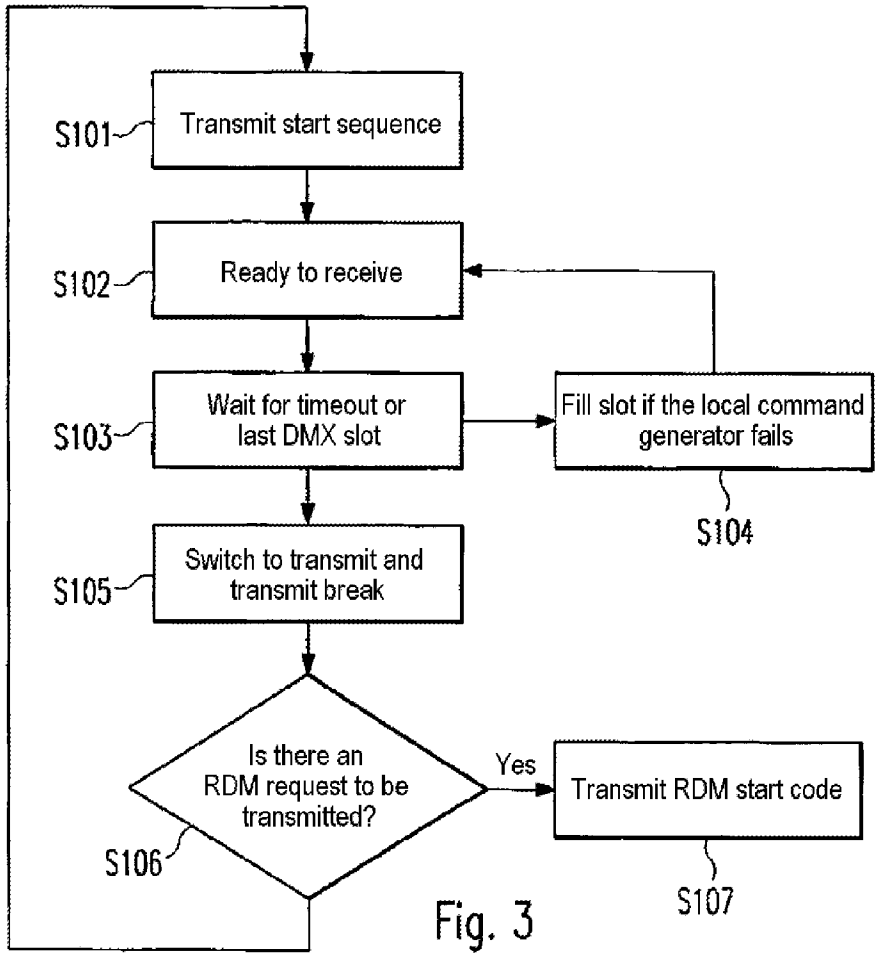
FIG. 3 shows a flow chart depicting the approach of the clock generator when generating the data packet.

The approach of the clock generator and a local command generator during the generation of a data packet according to the present invention is to be summarized again based on FIGS. 3 and 4, with FIG. 3 first depicting the approach of the clock generator. In this case, the transmission of the data packet is initiated by the transmission of the start sequence in step S101. The clock generator then switches into a ready-to-receive state (step S102), so that it is subsequently capable of monitoring the extent to which the additional command generators fill the data packet. This monitoring constitutes step S103, in which the clock generator waits until the transmission of the last data area or slot, but simultaneously checks whether no transmission takes place in the meantime, which indicates the failure of the corresponding command generator. In this case, the corresponding section is filled by the clock generator itself in step S104, as already mentioned, preferably with the information last transmitted by the corresponding command generator, and the clock generator again switches to ready-to-receive and continues to monitor the data transmission in step S103.

After transmitting the last data area, the clock generator then switches in step S105 once again to transmission and transmits a break signal, which accordingly constitutes the start sequence of the next packet.

The approach according to the present invention for generating a data packet for controlling the consumers is thereby basically completed, and step S101 could be immediately started again. However, in addition to the collective generation of a data packet according to the present invention, it may absolutely be provided that a conventional control of the consumers is carried out via a central control unit. In the present case, the clock generator thus checks in step S106 whether, for example, there is an RDM request to be transmitted, with the aid of which an individual device is thus individually contacted. If this is the case, a communication which is provided according to the RDM protocol subsequently takes place (step S107). If this communication is completed or if there is no RDM request to be transmitted, the transmission of the start sequence in step S101 may be started again, and a data packet is once again collectively transmitted.

However, from the point of view of a local command generator, the sequence is as depicted in FIG. 4, it being assumed that in a first step S201, the command generator assumes a ready-to-receive state. It then waits in step S202 for the transmission of the start sequence by the clock generator, so that it is synchronized with the additional devices for generating the data packet. At the point in time of the transmission of the area or slot which is assigned to the command generator, it switches in step S203 to transmission and then transmits the relevant information in step S204. The command generator then again switches to ready-to-receive, and the method starts again.

As already mentioned, the collective generation of a data packet according to the present invention may also be combined with a conventional control according to the DMX or RDM standard. In this case, the control of the consumers is then carried out via a central command generator in the conventional manner. However, at certain regular intervals, the command generator then initiates the transmission of a collectively generated data packet in accordance with the approach according to the present invention. In this case, the central command generator then preferably also assumes the function of the clock generator.

Alternatively, it would, however, of course also be conceivable that the control of the consumers is carried out exclusively within the scope of the approach according to the present invention. In this case, a central command generator is therefore no longer provided in the system itself; rather, only the central clock generator required for initiating the data packet transmission is required. This clock generator may constitute a unit which is independently connected to the system, or it may also be an integral part of one of the local command generators. However, in the case of a parallel use of conventional control and collective control, as mentioned above, the central clock generator is preferably an integral part of the central command generator.

Finally, with the aid of the approach according to the present invention, a very simple yet efficient control of the consumers may thus be carried out via local command generators. One particular advantage is also that existing systems may be expanded in a very simple manner via the method according to the present invention.

The invention claimed is:

1. A method for controlling consumers connected to a bus system, having a plurality of lamp operating devices, comprising:

providing at least one command generator and a central clock generator which is also connected to the bus system, controlling the lamp operating devices, where control is carried out via the transmission of data packets, and after the initiation of a data packet transmission via the central clock generator, the command generator fills an area of the data packet which is assigned to it, wherein multiple command generators are connected to the bus system and different areas of the data packet are assigned to each of them.

2. The method as claimed in claim 1, wherein the clock generator is an integral part of one of the command generators.

3. The method as claimed in claim 1, wherein the clock generator is a unit which is separated from the command generator(s), in particular is a central control unit.

4. The method as claimed in claim 1, wherein in the event that the command generator or one of the command generators is not capable of filling the area of the data packet which is assigned to it, the clock generator transmits the data last transmitted by the command generator in order to fill the corresponding area.

5. The method as claimed in claim 1, wherein the command generators are sensors and/or operating elements.

6. The method as claimed in claim 1, wherein the data transmission is carried out according to the DMX standard.

7. A system for controlling multiple consumers, in particular lamp operating devices, including:

a bus system to which the consumers are connected, and at least one command generator which is also connected to the bus system, wherein the control is carried out via the transmission of data packets, and the system furthermore includes a central clock generator, and the command generator is capable of filling an area of the data packet which is assigned to it after the initiation of a data packet transmission via the central clock generator, wherein multiple command generators are connected to the bus system and different areas of the data packet are assigned to each of them.

8. The system as claimed in claim 7, wherein the clock generator is an integral part of one of the command generators.

9. The system as claimed in claim 7, wherein the clock generator is a unit which is separated from the command generator(s), in particular is a central control unit.

10. The system as claimed in claim 7, wherein in the event that the command generator or one of the command generators is not capable of filling the area of the data packet which is assigned to it, the clock generator is designed to transmit the data last transmitted by the command generator.

11. The system as claimed in claim 7, wherein the command generators are sensors and/or operating elements.

12. The system as claimed in claim 7, wherein the data transmission is carried out according to the DMX standard.

13. A command generator for use in a system for controlling multiple consumers, in particular lamp operating devices, wherein the system includes a bus system to which the command generator, the consumers, and a central clock generator are connected, and wherein the control is carried out via the transmission of data packets, and the command generator is designed to fill an area of the data packet which is assigned to it after the initiation of a data packet transmission via the clock generator.

* * * * *